US006324875B1

(12) United States Patent
Hoermann

(10) Patent No.: US 6,324,875 B1
(45) Date of Patent: Dec. 4, 2001

(54) DEVICE FOR WASHING ALL TYPES OF CURTAINS

(76) Inventor: Wolfgang Hoermann, Goldberger Strasse 20, Zoelkow D-19374 (DE)

( * ) Notice: Subject to any disclaimer, the term of this patent is extended or adjusted under 35 U.S.C. 154(b) by 0 days.

(21) Appl. No.: 09/446,837

(22) PCT Filed: Jun. 25, 1998

(86) PCT No.: PCT/DE98/01743

§ 371 Date: Feb. 22, 2000

§ 102(e) Date: Feb. 22, 2000

(87) PCT Pub. No.: WO99/00047

PCT Pub. Date: Jan. 7, 1999

(30) Foreign Application Priority Data

Jun. 28, 1997 (DE) ..... 197 27 537
Oct. 28, 1997 (DE) ..... 197 47 524

(51) Int. Cl.[7] ..... D06B 1/02; B08B 3/02
(52) U.S. Cl. ..... 68/205 R; 134/199

(58) Field of Search ..... 134/199; 68/205 R

(56) References Cited

U.S. PATENT DOCUMENTS 5,106,426 4/1992 Konig et al. .

FOREIGN PATENT DOCUMENTS 1585775 7/1967 (DE) .
29511546U1 7/1995 (DE) .
19528857C1 8/1995 (DE) .
0352496 6/1989 (EP) .
0352496A3 6/1989 (EP) .

*Primary Examiner*—Philip R. Coe
(74) *Attorney, Agent, or Firm*—Darby & Darby

(57) ABSTRACT

A spraying device that is readily assembled and suitable for use with all types of curtains. The device includes two upper metal sheets and one supply line for both nozzle strips. An external holding device, such as a suction member, is used to support the device. The construction of the nozzle and nozzle strips provide a homogeneous cleaning of the entire length of the curtain.

16 Claims, 5 Drawing Sheets

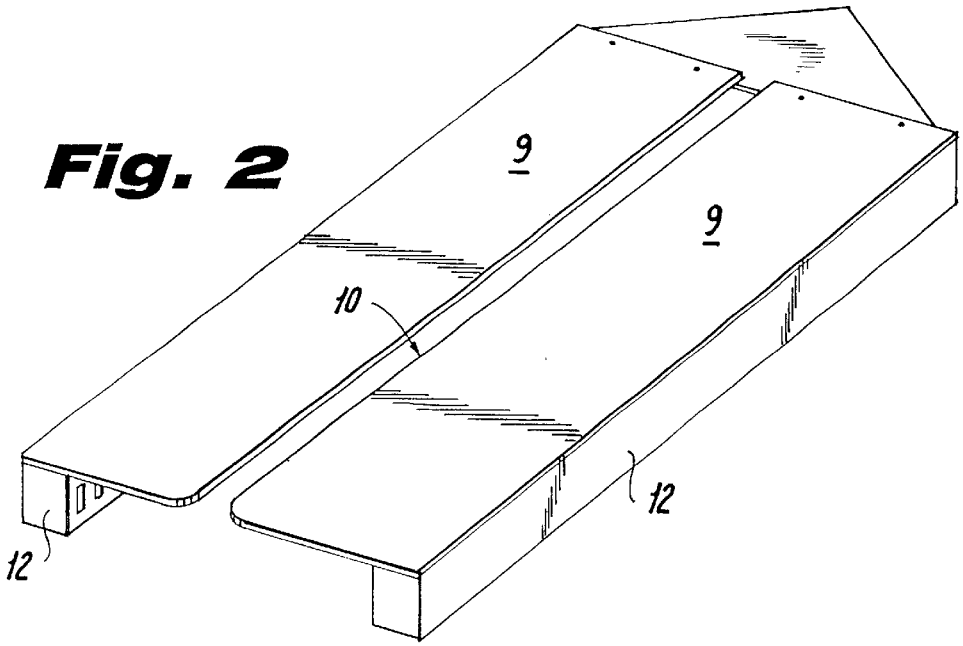
Fig. 2
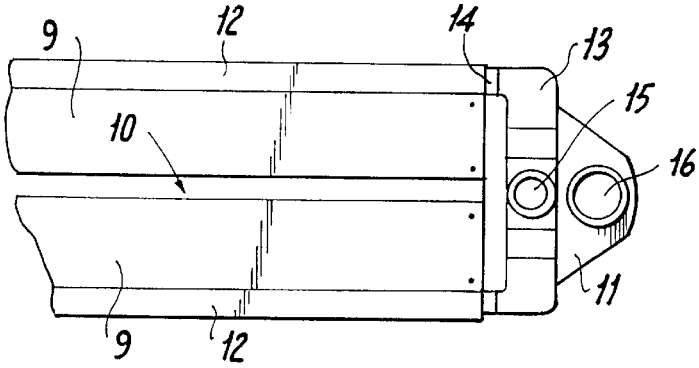
Fig. 3
Fig. 4
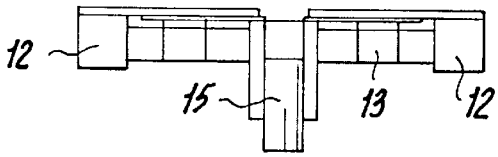
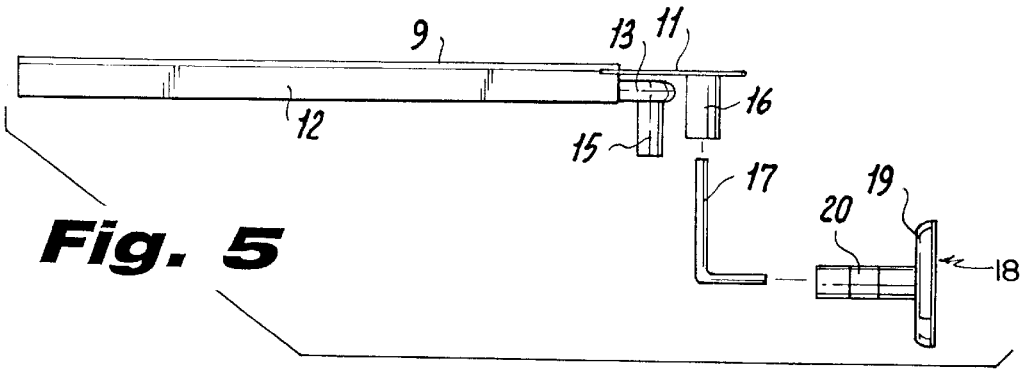
Fig. 5

Fig. 6
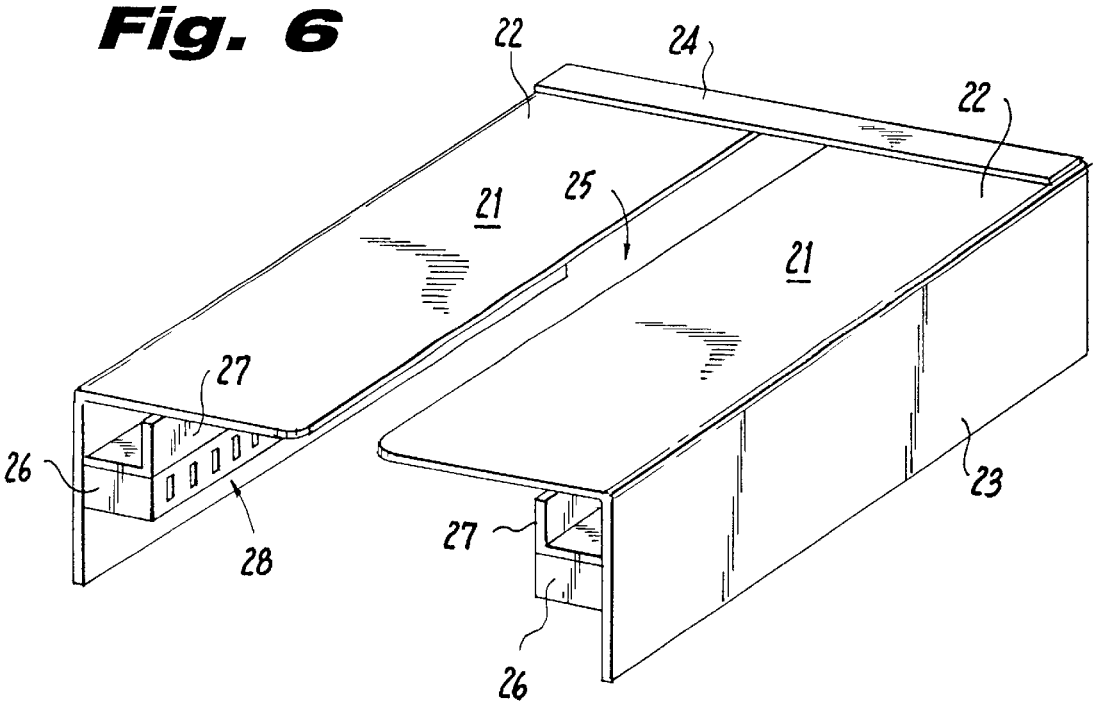
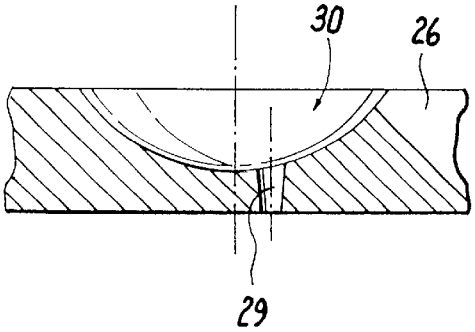
Fig. 8
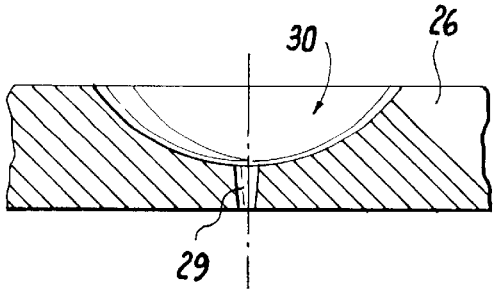
Fig. 7

DEVICE FOR WASHING ALL TYPES OF CURTAINS

BACKGROUND OF THE INVENTION

1. Field of the Invention

The present invention relates to a device for washing all types of curtains, such as vertical blinds, drapes and the like, wherein the curtain is in a suspended and collapsed state.

Such devices are predominantly used in the service industry for cleaning purposes.

2. Description of Related Art

Devices for washing suspended vertical lamellae are known in the art and typically consist of a wash container placed on the floor with supply hookups and a spraying head which is suspended on the top end of the vertical lamellae and connected to the wash container via supply lines. The spraying head and the lamellae, which are collapsed as a block, are enclosed by a tubular foil to protect the surroundings.

The washing solution is supplied with the help of the supply hookup via the supply line from the wash container to the spraying head, where the washing solution exits under pressure and impinges on the lamellae. The washing solution runs down inside the tubular foil and is collected by a catch basin or directly by the wash container and made available again to the wash process.

Different types of spraying heads are known. For example, European Patent No. 352 496 B1 discloses a nozzle rod which hangs from the running rail. This nozzle rod is implemented as a flat plate, has a plurality of horizontal supply channels and vertical nozzle bores and is placed between the curtain and the running rail, so that the washing solution jets impinge on the lamellae from above.

This nozzle rod cannot be manufactured due to the dimensional requirements or cannot be used due to the tight space between the lamellae and the running rail.

German Patent No. 195 28 857 C1 discloses a spraying device for vertical lamellae wherein the spraying device is predominantly box-shaped and has an open bottom side, an open end face and a top side with an elongated slot. Two separate opposing nozzle rails, which extend in a longitudinal direction and have nozzles oriented in the horizontal direction, are located inside the box-shape spraying device. Each nozzle rail has a connection at a respective end face for a respective supply line.

The spraying device is placed on the top of the vertical lamellae, so that the jets of the washing solution impinge on the vertical lamellae from the side.

The spraying device is quite compact and heavy.

In operation, it has been observed that the wet vertical lamellae and the relatively heavy spraying device with the two supply lines and the tubular foil exert additional stress on the running rails which the running rails frequently cannot withstand. Since the load bearing capacity of running rails is not known in advance and also cannot be tested, running rails are frequently torn off.

It is an additional disadvantage that the upper region of the vertical lamellae is only partially cleaned, because the nozzle rails inside the spraying device cannot be placed at a sufficient height due to design constraints.

It is another disadvantage that the width of the individual nozzle rails is determined by the structural design. Only a relatively small free space remains between the two nozzle rails as a result of the width of the nozzle rails in relation to the fixed width of the spraying device. As a result, wider vertical lamellae are difficult to clean.

Moreover, washing devices with spraying devices that are placed on top of the lamellae have the disadvantage that they can be used only with vertical lamellae. These devices cannot be used to wash drapes and curtains because drapes and curtains do not provide the necessary support at their respective upper sections.

All of the aforedescribed washing devices have a common disadvantage in that the spraying devices form a rigid system which cannot be adapted on location to the different curtain types and attachment modes.

It is therefore an object to provide a device for washing the aforedescribed types of curtains with a spraying device, which can be used universally for all types of curtains and independent of the specific attachment mode of the curtain, and which cleans the curtains across the entire length with a uniform quality.

SUMMARY OF THE INVENTION

The present invention is directed to a device for washing all types of curtains, wherein the curtain is in a suspended and collapsed state. The device includes a moveable wash container and a spraying device supplied from the wash container. The spraying device can be inserted between the curtain and the running rail of the curtain. Furthermore, the spraying device and curtain can be enclosed together with a tubular foil. The spraying device includes two nozzle rails, which are rigidly connected to one another, and connected to a supply line. Each nozzle rail has substantially uniformly spaced nozzles oriented so that the nozzles on one rail point in opposite directions to the nozzles on the other rail. In addition, each nozzle has a nozzle opening and an indentation. The spraying device includes a coupling for connecting to an external holding device. The inner surface of the nozzle rail extends to the height of the upper metal sheet or holding sheet, respectively. Furthermore, the longest axis of each of the indentations of the nozzles is oriented substantially perpendicularly to the horizontally extending nozzle rail. In addition, the indentations have, as observed from a top view, an elliptical shape with end sections having sharp edges; from a cross-sectional view, an involute shape; and in a longitudinal sectional view, the shape of a sector of a circle.

In an embodiment of the invention, the holding device may be a height-adjustable telescopic rod, which can be clamped between the floor and the ceiling of the room and has a clamp fitting for the coupling of the spraying device. Alternatively, the holding device may be an actuatable suction holder, which can be attached to a smooth surface in the room and connected to the coupling of the spraying device by an angled coupling element. In this alternative embodiment, the legs of the coupling element may be designed to have different heights.

The nozzle openings may be disposed at the deepest location of the indentation. Furthermore the nozzle openings may have an oval cross-section and a conical wall with the longest axis of the nozzle opening oriented substantially perpendicular to the horizontally extending nozzle rail.

In one embodiment the nozzle rail is arranged at a predetermined distance from the upper side of the holding metal sheets. A gap formed between the nozzle rail and the upper side of the holding metal sheet may be covered by a cover panel. Alternatively, the nozzle rails may be attached directly on the bottom side of two upper metal sheets, wherein the upper metal sheets are spaced apart and substantially parallel to one another so as to define therebetween a slot that is open on one side. The nozzle rails have a dimensional ratio between the width and the height of less than one. Furthermore, the nozzle rails are connected to one another, for example, directly to their respective inner sides, by a connecting element and have a common supply hookup. Alternatively, the connecting element may be connected to the respective end faces of the nozzle rails by a respective adapter.

The invention eliminates the disadvantages of the prior art devices discussed above. Accordingly, the spraying device is optionally placed on the lamellae or is supported exclusively by an external holding device. In this way, washing device can be used not only with vertical lamellae, but also with all the other types of curtains which do not provide a corresponding Support surface.

This holding device, which may consist of a height-adjustable telescopic rod or an actuatable suction holder, also completely eliminates the risk that the running rail is torn from its anchoring support or that the relatively thin rollers for the curtains break off, because the wet condition of the curtains and the relatively heavy spraying device with the two supply hoses and the tubular foil have a substantial weight and therefore apply excessive stress to the support. Moreover, the extremely light-weight construction of the spraying device consists in essence only of a one-piece circumferential nozzle rail and two planar upper metal sheets for spray protection and furthermore requires only a single supply line. This reduces the weight to approximately one-third of that of the conventional spraying device. Substantial cost savings are also achieved. Since the nozzle rails can be mounted at the greatest possible height of the top metal sheets and a wide, linearly extending horizontal water jet can be attained, the entire length of the curtain can now be uniformly cleaned.

Advantageously, the linear water jet stripe can be adjusted in height by offsetting the nozzle openings from the center of the indentations. The water jets can now safely reach also the upper end portions of the curtains.

Advantageously, the inner surface of the nozzle rail may extend to the top of the upper metal sheet by attaching the nozzle rail directly to the upper metal sheet or by inserting a cover panel if a gap from the upper metal sheet is desired. This arrangement prevents dirt from depositing in the gap which may otherwise soil the curtains again when the device is removed.

Particularly advantageously, the opposing nozzle rails may be functionally connected by a connecting element. Both nozzle rails arc thereby short-circuited so that only a single common supply hookup and also only a single common supply line are required. This again reduces the weight and lowers the costs.

In addition, the dimensions of the width and the height of the nozzle rails can advantageously be matched to one another. In the conventional spraying) devices where the fitting for the separate supply hookup is threaded and can only be placed on an end face, a width-to-height ratio of 1:1 is required. With a device of the invention, on the other hand, the width of the nozzle rail can be freely selected, since an adapter can be used if the fitting is located on an end face, or the supply lines can alternatively be hooked up directly to the sides of the nozzle rails. This arrangement significantly increases the spacing between the nozzle rails, so that, for example, wider vertical lamellae can also be washed.

BRIEF DESCRIPTION OF THE DRAWING

The invention will be described hereinafter with reference to a specific embodiment.

FIG. 2 is a perspective illustration of a spraying device;

FIG. 3 is a partial view of the spraying device in FIG. 2;

FIG. 4 is a side view of the spraying device in FIG. 2;

FIG. 5 is a different side view of the spraying device with a suction holding device;

FIG. 6 is a perspective view of a modified spraying device;

FIG. 7 is a cross-sectional view of a first nozzle;

FIG. 8 is a cross-sectional view of a second nozzle;

DETAILED DESCRIPTION OF THE PREFERRED EMBODIMENTS

Figure 1:
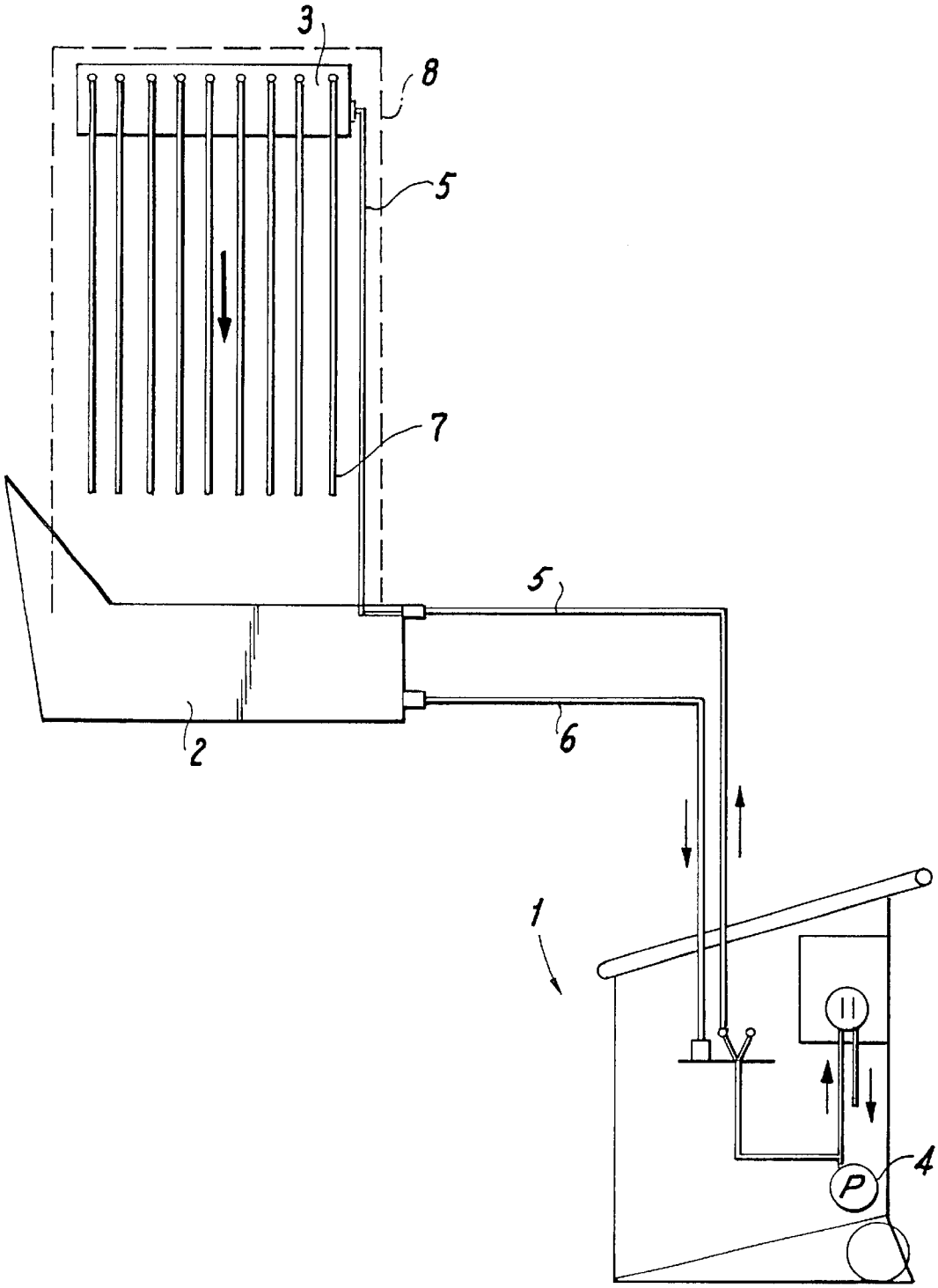
FIG. 1 is a schematic illustration of the washing machine with a catch basin.

The washing machine shown in FIG. 1 consists essentially of a wash container 1, a catch basin 2 and a spraying device 3. A pump 4 located in the wash container 1 is connected to the spraying device 3 via a supply line 5, with a return line 6 running from the catch basin 2 to the wash container 1.

In addition to the pump 4 and the additional valves and connections, an operator console for the required switching and control devices may be located inside the wash container 1. A curtain 7 is collapsed into a block on a running rail (not shown). A tubular foil 8 surrounds the curtain 7 and the spraying device 3. The tubular foil 8 is gathered above the spraying device 3 and hangs downwardly together with the curtain 7 to reach the catch basin 2. The spraying device 3 is designed so that it can be inserted above the curtain 7 which has been collapsed into a block.

The spraying device 3 shown in FIGS. 2 to 5 consists of two spaced apart upper metal sheets 9 having a smaller width and a greater length, with the dimensions matching the expected the dimensions of the curtain block. The two upper metal sheets 9 form therebetween a slot 10 extending over the length of the upper metal sheets 9. One end of the two upper metal sheets 9 is held together by a holding metal sheet 11.

Alternatively, the two top metal sheets 9 and the holding metal sheet 11 can also be formed as a single piece.

A nozzle rail 12 which has inwardly pointing nozzles and likewise extends over the length of the upper metal sheets 9, is attached to the bottom side in the region of the outside edge of each upper metal sheet 9. The ends of each of the nozzle rails 12 where the holding metal sheet 11 is located, are short-circuited through a connecting element 13. The connecting element 13 is preferably connected to the end face of each nozzle rail 12 by a respective adapter 14.

Alternatively, the connecting element 13 can also be directly connected to the inner sides of the nozzle rails 12. In the center region between the two nozzle rails 12, the connecting element 13 has a downwardly pointing supply hookup 15 for the supply line 5. In this way, a single supply line 5 supplies both nozzle rails 12.

Figure 5A:
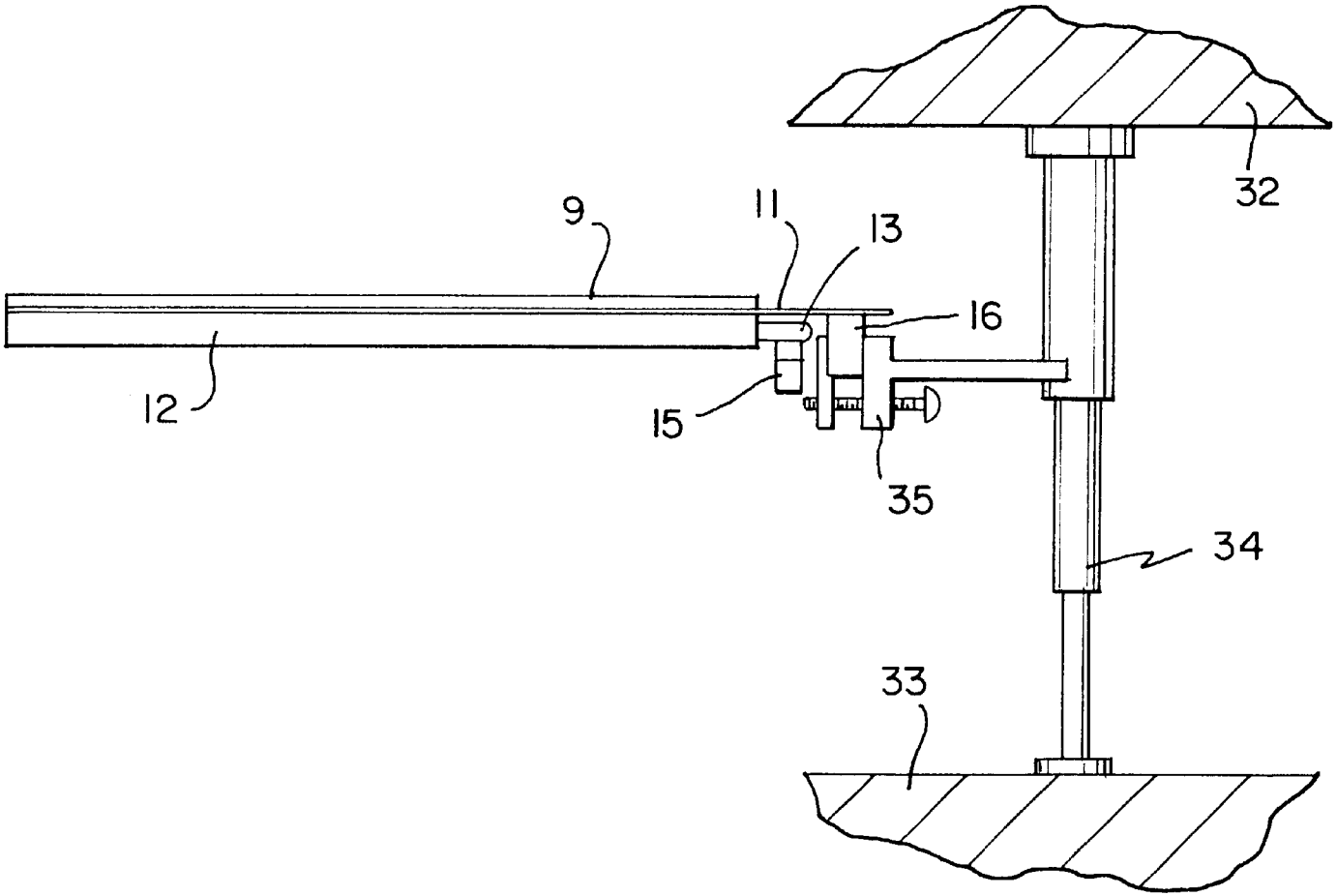
FIG. 5*a* is a side view of the spraying device with a telescopic rod holding device.
Figure 9:
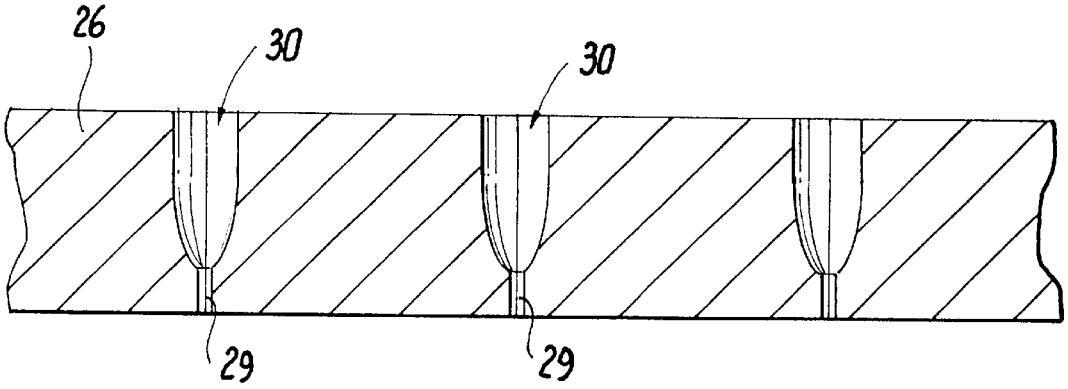
FIG. 9 is a longitudinal cross-section of a nozzle rail.
Figure 10:
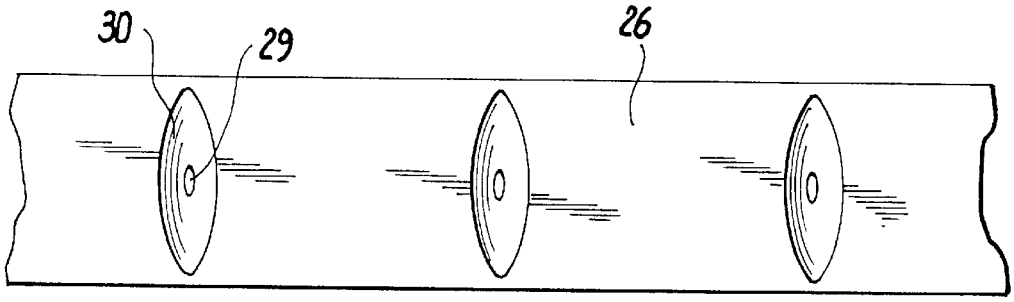
FIG. 10 is a top view of a nozzle rail.

A first coupling 16 for the coupling element 17 is located on the bottom side of the holding metal sheet 11. The coupling element 17 is designed as a connector between the holding metal sheet 11 and a suction holder 18 and consists preferably of an angled round bar with legs of different length. The suction holder 18 includes an adjustable suction cup 19 to be applied to a surface, such as a relatively smooth wall, and a connector 20 which can be adjusted in a plane. FIG. 5*a* shows a weight-adjustable telescopic rod 34 that can be clamped between a floor 33 and a ceiling 32 of a room. The telescopic rod 34 is attached to the coupling 16 by a clamp fitting 35.

FIG. 6 shows a modified spraying device 3, which consists of two angled holding metal sheets 21, each having a horizontal upper side 22 and a vertical long side 23. Both holding metal sheets 21 are spaced apart and parallel to each other and are held together at respective end faces by an overlapping connecting metal sheet 24. The spacing between the two holding metal sheets 21 is formed as a slot 25 having a predetermined width. The slot 25 is open towards one end face and covered by the connecting metal sheet 24 towards the opposite end face.

A nozzle rail 26 extending over the entire length of the spraying device 3 is placed on the inner surface of each long side 23 of the holding metal sheets 21. The nozzle rail 26 is connected in the region of the connecting metal sheet 24 to the supply line 5 running to the wash container 1 by a fitting (not shown). Accordingly, two nozzle rails 26 of the spraying device 3 face each other and are arranged at the same height and with a predetermined height difference relative to the upper side 22 of the holding metal sheet 21. Preferably, the nozzle rails 26 have a rectangular cross section. The free space created in this way above the nozzle rails 26 between the nozzle rails 26 and the holding metal sheet 21 is covered towards the inside of the spraying device 3 by a cover panel 27.

The nozzle rails 12, 26 of both embodiments of the spraying device 3 have nozzles 28 located in the inner wall which faces the lamellae. The nozzles 28 arc arranged in a horizontal row with even spacing therebetween. Accordingly, the rows of the nozzles 28 of the two opposing nozzle rails 12, 26 are oriented in the same direction and face each other.

As shown in FIGS. 7 to 10, each nozzle 28 consists of a nozzle opening 29 and an indentation 30, wherein the indentation 30 is located on the outer side and the nozzle opening 29 is located on the inner side of the inner wall of the nozzle rail 12, 26. The indentation 30 is similar in shape and outside dimension to a disk milling cutter for the involute of a gear tooth arrangement and is formed by undercutting with the involute milling cutter. Accordingly, the recess has in top view the form of an ellipse (FIG. 10) terminated by a sharp edge, in cross-sectional view the shape of an involute (FIG. 9), and in a longitudinal section the shape of a sector of a circle (FIGS. 7 and 8).

The indentations 30 are formed in such a way that the longitudinal axis of the ellipse is oriented perpendicular to the horizontally extending nozzle rail 12, 26.

The nozzle opening 29 is formed in the region of the deepest point of the indentation 30, with the nozzle opening 29 located either exactly in the center of the indentation 30 or, as seen in FIG. 8, closely above or below the center of the indentation 30.

Accordingly, the depth of the sector of the circle takes up most of the space in the inner wall of the nozzle rail 12, 26, as compared to the depth of the nozzle opening 29. The nozzle opening 29 has an elliptical cross-section and depthwise a conical shape, wherein the major axis of the ellipse of the nozzle opening 29 is oriented in the same direction as the major axis of the ellipse of the indentation 30.

The operating principle of the entire lamellae washing machine is generally known. The pump 4 pumps washing or rinsing solution from the wash container I through the supply line 5 to the spraying device 3, where the solution exits under pressure and impinges on the curtain which collapsed into a block. The cleaning or rinsing solution runs down the curtain and is returned either directly or via the catch basin 2 to the wash container 1.

The circulation is maintained for a predetermined period of time.

A novel feature is the cooperation of the spraying device 3 with the suction holder 18. The spraying device 3 is inserted between the curtain 7 and the running rail so that the support links of the rollers project through the slot 10, 25 of the upper metal sheets 9, 21. The coupling element 17 is then inserted with one end into the coupling 16 and with the other end into the connector 20 of the suction holder 18 and secured. The suction holder 18 is then placed at a suitable distance from the spraying device 3 on the glass cover panel or another smooth wall surface, for example the ceiling, which are located in close proximity, and attached thereto by suction. The height of the spraying device 3 is adjusted so as to be positioned in the free space between the running rail and the upper end of the curtain 7 and to be supported only by the force of the suction holder 18. The different length of the legs of the coupling element 17 and the pivotable connector on the suction holder 18 makes it possible to adapt the suction holder 1 8 to any desired location. The tubular foil 8 is then pulled over the curtain 7 and the spraying device 3 in a mainer known in the art.

In spite of the perpendicular arrangement of the indentations 30 and the particular design of the nozzle openings 29 and the indentations 30, as well as their respective location and functional cooperation, the water exits from each nozzle 28 exactly horizontally and in a wide fan-shaped pattern. Accordingly, the water impinges on the curtain in a continuous linear pattern due to the cooperation of all nozzles 28 and cleans the curtain.

The angle of incidence of the water jet on the curtain and thereby also the active washing height can be adjusted by adjusting the spacing between the center of the nozzle opening 29 and the center of the indentation 30 upwardly or downwardly.

During the washing operation with the spraying device according to FIG. 6, the soiled water which penetrates the curtain, impinges of the opposite cover panel 27 and runs downwardly over the cover panel 27. The curtain is therefore adequately cleaned and the interior of the spraying device 3 is also kept clean, so that the curtain is not soiled again when the spraying device 3 is removed.

What is claimed is:

1. A device for washing all types of curtains while in a suspended and collapsed state, the curtain including a running rail, comprising:

a moveable wash container;

a spraying device receiving a fluid from the wash container via a supply line, the spraying device being insertable between the curtain and the running rail of the curtain, the spraying device comprising:

two upper metal sheets;

two nozzle rails each having an inner surface, the nozzle rails being rigidly connected to one another by a connecting element and connected to the supply line; each nozzle rail having substantially uniformly spaced nozzles oriented so that the nozzles on each rail are pointing in opposite directions towards one another; the inner surface of each of the nozzle rails extending to the upper metal sheets; each nozzle having a nozzle opening and indentation defined therein; each indentation being: (i) elliptical in shape, when viewed from the inner surface of the nozzle rail, with sharp end sections and a major axis of the ellipse oriented substantially perpendicular to a longitudinal axis of the nozzle rail; (ii) involute in shape, when viewed along a longitudinal cross-section of the nozzle rail; and (iii) circular in shape, when viewed along a lateral cross-section of the nozzle rail;

an external holding device for supporting the spraying device;

a coupling interposed between the connecting element and the holding device; and a tubular foil for enclosing the curtain and spraying device.

2. The device in accordance with claim 1, wherein the holding device is a height-adjustable telescopic rod with a clamp fitting for receiving the coupling of the spraying device, the telescopic rod adjustable so as to be clamped between a floor and a ceiling of a room.

3. The device in accordance with claim 1, wherein the holding device is a suction holder adaptable so as to be attached to a surface, the suction holder being connected to the coupling of the spraying device by an angled coupling element.

4. The device in accordance with claim 3, wherein the angled coupling element has legs of different lengths.

5. The device in accordance with claim 1, wherein each nozzle opening is disposed at a deepest location of the indentation.

6. The device in accordance with claim 1, wherein each nozzle opening is: (i) oval in shape, when viewed from the inner surface of the nozzle rail and a major axis of the oval is oriented perpendicular to the longitudinal axis of the nozzle rail; and (ii) conical in shape, when viewed along a longitudinal cross-section of the nozzle rail and along a lateral cross-section of the nozzle rail.

7. The device in accordance with claim 1, wherein the nozzles of each nozzle rail are separated from an upper surface of the metal sheets by a predetermined distance to form a gap therebetween covered by a panel.

8. The device in accordance with claim 7, wherein each of the nozzle rails has a width-to-height dimensional ratio less than approximately one.

9. The device in accordance with claim 8, further comprising:

a connecting element for connecting the nozzle rails to one another; and a common supply hookup connected to both of the nozzle rails.

10. The device in accordance with claim 9, wherein the connecting element is connected directly to the inner sides of the nozzle rails.

11. The device in accordance with claim 9, further comprising an adapter for connecting the connecting element to respective end faces of the nozzle rails.

12. The device in accordance with claim 1, wherein the nozzle rails are attached directly to a bottom surface of the metal sheets, and the metal sheets are disposed parallel to and separated from one another to form a slot therebetween, open on one side.

13. The device in accordance with claim 12, wherein each of the nozzle rails has a width-to-height dimensional ratio less than approximately one.

14. The device in accordance with claim 13, further comprising:

a connecting element for connecting the nozzle rails to one another; and a common supply hookup connected to both of the nozzle rails.

15. The device in accordance with claim 14, wherein the connecting element is connected directly to the inner sides of the nozzle rails.

16. The device in accordance with claim 13, further comprising an adapter for connecting the connecting element to respective end faces of the nozzle rails.

* * * * *